US007187891B2

(12) United States Patent
Tanaka

(10) Patent No.: US 7,187,891 B2
(45) Date of Patent: Mar. 6, 2007

(54) DEVELOPING APPARATUS INCLUDING ROTARY MEMBER FOR ACCOMMODATING VARIABLE COMBINATIONS OF DEVELOPING SLEEVES AND BALANCE WEIGHTS

(75) Inventor: Akinori Tanaka, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 65 days.

(21) Appl. No.: 11/113,246

(22) Filed: Apr. 25, 2005

(65) Prior Publication Data

US 2005/0244192 A1 Nov. 3, 2005

(30) Foreign Application Priority Data

Apr. 28, 2004 (JP) ..... 2004-134763

(51) Int. Cl.
*G03G 15/01* (2006.01)

(52) U.S. Cl. ..... 399/227; 399/226

(58) Field of Classification Search ..... 399/227, 399/226, 228

See application file for complete search history.

(56) References Cited

U.S. PATENT DOCUMENTS 6,487,387 B2 11/2002 Kusaba et al. ..... 399/302
6,661,987 B2 12/2003 Hiroki ..... 399/227
2003/0142996 A1 7/2003 Hiroki ..... 399/227

FOREIGN PATENT DOCUMENTS

JP 57070547 A * 5/1982
JP 9-288419 11/1997
JP 2000-134045 5/2000
JP 2003-50494 2/2003
JP 2003173080 A * 6/2003
JP 2003-233239 8/2003

* cited by examiner

*Primary Examiner*—David M. Gray
*Assistant Examiner*—Erica J. Villaluna
(74) *Attorney, Agent, or Firm*—Fitzpatrick, Cella, Harper & Scinto

(57) ABSTRACT

A developing apparatus for developing an electrostatic image on an image bearing member includes a rotary member including a plurality of mounting portions, to which a plurality of developing devices and a plurality of balance weights are detachably mountable. The rotary member selectively shifts a mounted developing device to a developing position opposite to the image bearing member. A developing process is performed in a first mode in which developing devices are attached to all the mounting portions, and in a second mode in which a developing device is mounted to at least one of the mounting portions, and no developing devices are mounted to the remaining mounting portions, and wherein, in the second mode, balance weights are mounted to the remaining mounting portions. An image forming apparatus includes an image bearing member and the developing apparatus.

13 Claims, 12 Drawing Sheets

DEVELOPING APPARATUS INCLUDING ROTARY MEMBER FOR ACCOMMODATING VARIABLE COMBINATIONS OF DEVELOPING SLEEVES AND BALANCE WEIGHTS

BACKGROUND OF THE INVENTION

1. Field of the Invention

The present invention relates to a developing apparatus used for an image forming apparatus, such as a printer, a copier or a facsimile machine, and particularly to a developing apparatus that employs a plurality of developing devices mounted on a rotary member to perform multi-color developing for two or more colors.

2. Description of the Related Art

Recently, there has been a rapid increase in strongly expressed requests for the downsizing of color copiers (color image forming apparatuses) and improvements in the quality of images.

In order to respond to these requests, many image forming apparatuses of a single-drum, rotary-member developing type have been proposed, wherein single photosensitive drums are employed as image bearing members and a plurality of developing devices are mounted on rotary members (rotary developing devices), and wherein, for developing performance, the rotary members are rotated to move desired developing devices to developing positions opposite to the photosensitive drums.

These image forming apparatuses are provided to save space by mounting a plurality of developing devices on a rotary member, and to attain high image quality, through the stabilization of color hues, by providing a constant developing position on a photosensitive drum and by reducing the misregistration that can result from the use of a single-drum system.

Disclosed in the prior art is JP-A-Hei 09-288419 (see FIG. 9), which is a configuration, wherein not only developing devices 4*a*, 4*b* and 4*c* but also a toner supply unit 201 and toner cartridges 202*a*, 202*b*, 202*c* and 202*d* are mounted on a rotary member 4A, and all the components are rotated together. The features of this configuration are that a toner supplement path from the toner cartridges to the developing devices is short and requires only a simple structure, and that because of these features, the configuration can be provided at a low cost.

Disclosed in the prior art is JP-A-2001-134045 (see FIG. 10), which is a configuration wherein a toner supply unit 203 and a toner cartridge 204 are located outside a rotary member 206 on which a developing device 205 is mounted, and toner is supplied externally to the developing device 205 on the rotary member 206. The features of this configuration are that, since the toner cartridge 204 is not present inside the rotary member 206, the downsizing of the rotary member 206 is enabled, and that the capacity of the toner cartridge 204 can be increased.

Furthermore, image forming apparatuses have recently been proposed wherein added values, such as high speeds, high image quality and high functions, are also provided for the structures of a rotary member, or a rotary member and a developing device, and a toner cartridge.

For example, disclosed in the prior art is JP-A-2003-050494 (see FIGS. 11A, 11B, and 11C), which discloses a method for driving the rotary member 4A under a condition wherein developing devices are unevenly arranged. Furthermore, disclosed in the prior art is JP-A-2003-233239 (see FIG. 12), which is a method whereby developing devices 4*a*, 4*b*, 4*c* and 4*d* are arranged on one side of a rotary member 4, so as to easily drive the rotary member 4 when the developing devices are switched.

As is described above, the main purposes of the single-drum configuration, wherein the developing devices are mounted on the rotary member, are an improvement in the image quality and an increase in the space saved.

However, with the configuration wherein images are formed by rotating and changing the developing devices mounted on the rotary member, image smearing will occur due to the vibration, or the impact, that occurs when the developing devices are switched or the rotation is halted, so that this is an unfavorable configuration for improving the image quality, which is the original object.

Therefore, in the present situation, for many image forming apparatuses, various and numerous technical countermeasures are taken to switch between the developing devices, i.e., for the control and the structure of the rotary member.

Among these technical countermeasures, very effective ones are a technique for obtaining a balance in the rotation of the rotary member, a technique for reducing the size of the rotary member, so as to minimize the rotational inertia and rotational energy, and a technique for the moderate driving of the rotary member.

For the reduction in the size of the rotary member, balancing this with the downsizing of the developing devices must be considered in order to maintain the image quality.

When the technical theme for coping with the high image quality is considered, the technique proposed in JP-A-Hei 09-288419 has the following problems. Since the toner supply unit and the toner cartridges are mounted on and rotated with the rotary member and with the developing devices, it can be easily understood that the weight balance between the toner container and the developing devices on the rotary member will change as the toner is consumed. For this configuration, it is very difficult, for the rotational balance of the rotary member to be maintained. Further, when rotational vibration occurs, due to degradation of the rotational balance, or when there is an increase in the impact, due to the halting of the rotary member, it has a direct, adverse affect on the quality of an image, and rotational vibration is transmitted to an optical system and affects the scanning process, so that image deterioration occurs.

The method, disclosed in JP-A-2003-050494, for driving the rotary member while the developing devices are unevenly arranged has the following problems. The method used to reduce the speed of the rotary member, when the balance is inappropriate, insufficiently reduces the uneven rotation and the shock that occurs when the rotary member is inappropriately balanced. Since in this case the speed of the rotary member is reduced, this is an effective configuration that can provide control for the output of a drive motor and for a torque margin; however, there is a considerable reduction in the productivity of the image forming apparatus.

With this configuration, the developing devices are switched at the interval between recording media, and it is highly probable that the number of image forming faces will be restricted and a reduction in the productivity cannot be avoided.

According to the configuration described in JP-A-2003-233239, wherein the developing devices are arranged along one side of the rotary member, the rotary member for changing the developing device can be driven easily because only a small rotational angle is required. However, it can easily be understood that, even when toner cartridges are provided to maintain the balance, the balance of the rotary member is lost as the toner is consumed. Thus, the deterioration of an image due to the poor balance of the rotary member can not be avoided. Further, with this configuration, since the developing devices are located along one side of the rotary member, the diameter of the rotary member is increased. As a result, the rotational inertia of the rotary member is increased, and accordingly, the impact when the rotary member is halted is increased, so that image deterioration occurs. To resolve this problem, the developing devices must be thin and have reduced sizes, or else stable circulation of the developer and developing performance will be adversely affected. Otherwise, image forming will be performed only at a speed consonant with the size of the developing devices, and the productivity will be reduced.

While taking the above description into account, the configuration as proposed in JP-A-2001-134045 is preferable in order to drive the rotary member without uneven rotation being caused. That is, it is preferable that the toner supply unit and the toner cartridges be located separately from the rotary member, whereon the developing devices are mounted, and supply toner to the developing devices.

According to this arrangement, since the toner cartridges are located separately from the rotary member, a change in the weight balance as the toner is consumed does not affect the rotary member, and by controlling the toner density, a constant amount of toner can be maintained in the developing devices on the rotary member, regardless of the toner color.

SUMMARY OF THE INVENTION

The present invention provides a developing apparatus that prevents image deterioration due to uneven rotation of a developing rotary, even when all of the developing devices are not attached.

According to this invention, a developing apparatus for developing an electrostatic image on an image bearing member comprises:

a rotary member including a plurality of mounting portions, from which a plurality of developing devices are detachable, wherein, from among the plurality of developing devices mounted, the rotary member selectively shifts an arbitrary developing device to a developing position opposite the image bearing member, wherein a developing process is performed in a first mode in which the developing devices are attached to all the mounting parts, and in a second mode in which the developing devices are attached to one of the mounting portions, and no developing devices are attached to the remaining mounting parts, and wherein, in the second mode, detachable weights are attached to the remaining mounting parts.

Further features and advantages of the present invention will become apparent from the following description of exemplary embodiments with reference to the attached drawings.

DESCRIPTION OF THE EMBODIMENTS

Figure 1:
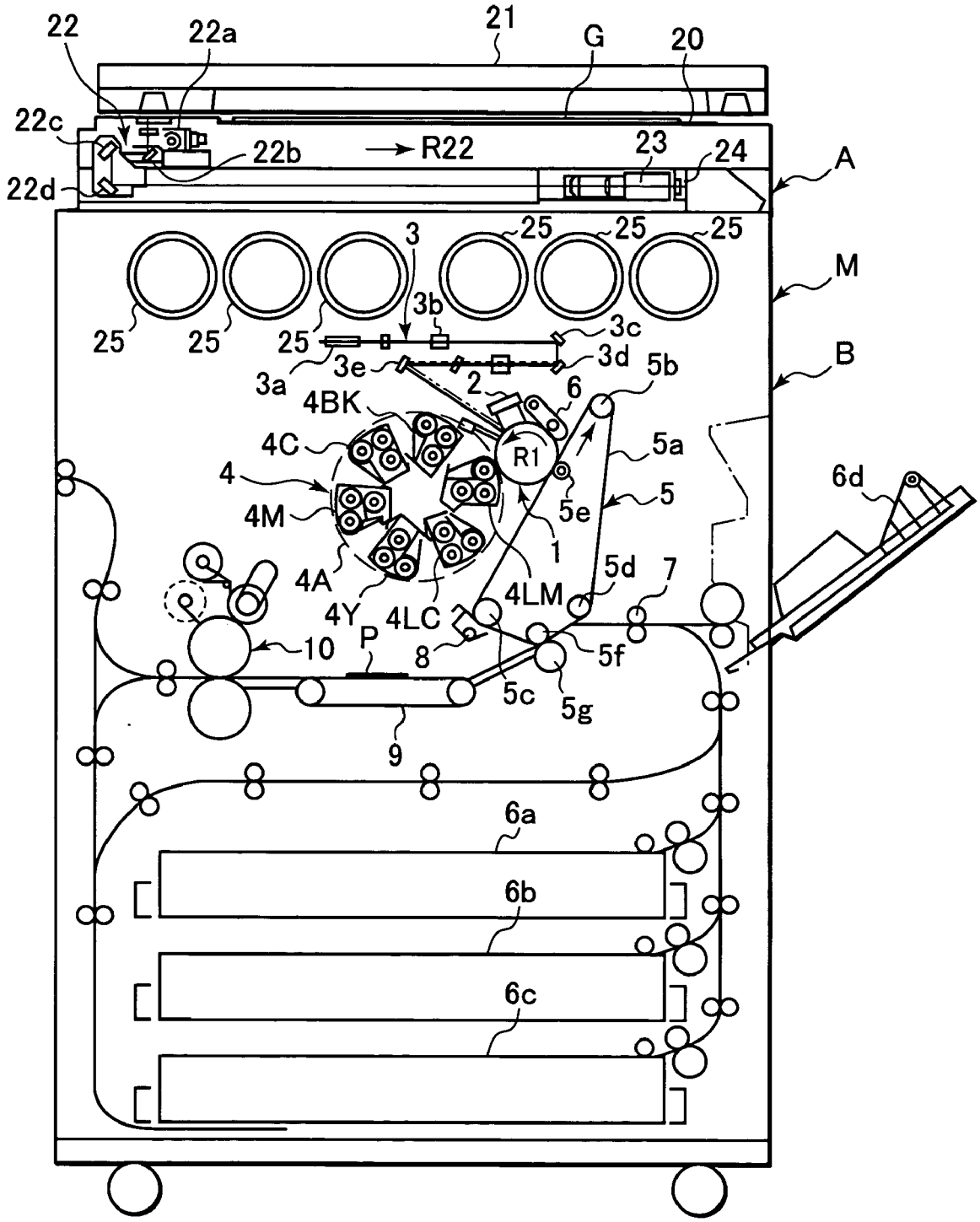
FIG. 1 is a vertical front cross-sectional view of the schematic configuration of an image forming apparatus according to the present invention.

Embodiments of the present invention will now be described while referring to the accompanying drawings. Since components denoted by the same reference characters have the same structure or perform the same function, an explanation for them will not be repeated <First Embodiment>

FIG. 1 is a vertical cross-sectional view of the schematic configuration of an image forming apparatus according to this invention.

The image forming apparatus in FIG. 1 is a full color image forming apparatus wherein a digital color image reader A (hereinafter referred to simply as a reader A), for reading an image on a document G, is located above and a digital color image primer B (hereinafter referred to simply as a printer B), for forming an image, is located below. The printer B includes a photosensitive drum that serves as an image bearing member, a rotary type developing apparatus and an intermediate transfer belt that serves as an intermediate transfer member.

A document table glass 20, a document holding plate 21, a scan unit 22, a lens 23 and a CCD 24 are arranged in the reader A. The scan unit 22 includes a light source 22*a* and a plurality of mirrors 22*b*, 22*c* and 22*d*, and the entire unit is shifted from the home position shown in FIG. 1 in the direction indicated by an arrow R22. The document G is placed on the document table glass 20 with the image surface down. When the scan unit 22 is moved in the direction indicated by the arrow R22, the image surface of the document G is read. That is, while the scan unit 22 is moving in the direction indicated by the arrow R22, light emitted by the light source 22*a* of the scan unit 22 radiates the image surface of the document G. The light reflected from the image surface is then reflected by the mirrors 22*b*, 22*c* and 22*d* and light is transmitted through the lens 23 to the CCD 24, where it is converted into an electric signal. An image processor (not shown) performs various image processes, such as shading correction, color correction and density process, for the electric signal, and transmits the resultant signal to an exposure apparatus that will be described later.

In the printer B, an electronic photosensitive member having a drum shape (hereinafter referred to as a photosensitive drum) 1 is provided as an image bearing member. The photosensitive drum 1 is supported by an image forming main body (hereinafter referred to simply as a main body) M so as to be rotatable in the direction indicated by an arrow R1. Around the photosensitive drum 1, a primary charging device (charging means) 2, an exposure apparatus 3, a developing apparatus 4, a transfer apparatus 5 and a cleaning apparatus 6 are arranged, substantially in that order, along the rotational direction of the photosensitive drum 1. The primary charging device 2 uniformly charges the surface of the photosensitive drum 1 at a predetermined polarity and a predetermined potential. The exposure apparatus 3 includes a laser output unit (not shown), a polygon mirror 3*a,* a lens 3*b* and reflection mirrors 3*c,* 3*d* and 3*e.* An image read by the reader A is converted, by the laser output unit, into optical signals for individual colors. The laser light for the first color, which is one of the obtained optical signals, is reflected by the polygon mirror 3*a,* passes through the lens 3*b* and is reflected by the reflection mirrors 3*c,* 3*d* and 3*e,* and exposes the surface of the photosensitive drum 1, which has been charged. As a result, an electrostatic latent image for the first color is formed on the photosensitive drum 1.

The developing apparatus 4 includes a rotatable developing rotary 4A and six (six colors) developing devices mounted to the developing rotary 4A, i.e., a yellow (Y) developing device 4Y, a magenta (M) developing device 4M, a cyan (C) developing device 4C, a black (BK) developing device 4BK, a light (thin) magenta (LM) developing device LM and a light (thin) cyan (LC) developing device 4LC. Within the developing apparatus 4, as the developing rotary 4A is rotated, the developing device used to develop each color is moved to a developing position D (see FIGS. 2 and 6) opposite the photosensitive drum 1, and to obtain a toner image, attaches toner to the electrostatic latent image on the photosensitive drum 1. The developing apparatus 4 will be described later in detail.

The transferring apparatus 5 has an intermediate transferring belt 5*a,* which is an intermediate transfer member extended along a plurality of rollers, i.e., a drive roller 5*b,* a coupled roller 5*c,* a tension roller 5*d,* a primary transfer roller 5*e,* a secondary transfer opposed roller 5*f* and a secondary transfer roller 5*g*. The toner image on the photosensitive drum 1 is transferred to the intermediate transfer belt 5*a* by the primary transfer roller 5*e* (primary transfer process).

After the primary transfer process for the toner image has been completed, the toner (residual toner) on the surface of the photosensitive drum 1 is removed by the cleaning apparatus 6 to prepare for the next color image forming process.

The image forming sequence, including the primary charging, the exposure, the developing, the primary charging and the cleaning, is repeated for the other five colors. As a result, toner images for six colors are superimposed on the intermediate transfer belt 5*a.*

The toner images for the six colors formed on the intermediate transferring belt 5*a* are collectively transferred to a recording medium P, which is conveyed between the intermediate transfer belt 5*a* and the secondary transfer roller 5*g*. The recording medium P is fed from a paper cassette 6*a,* 6*b* or 6*c,* or a manual feed tray 6*d,* and is conveyed by a feeding roller and a conveying roller to a registration roller 7, where the tilted positioning is corrected and the conveying is temporarily halted. The recording medium P is then fed between the intermediate transfer belt 5*a* and the second transfer roller 5*g* by the registration roller 7 in synchronization with the movement of the six color toner images on the intermediate transfer belt 5*a,* and the six color toner images are collectively transferred from the intermediate transfer belt 5*a* to the recording medium P. After the toner images have been transferred, the toner (residual toner) remaining on the surface of the intermediate transferring belt 5*a* is removed by a belt cleaner 8 to prepare for the next transfer process.

The recording medium P bearing the toner image is conveyed along a conveying belt 9 to a fixing apparatus 10, where the toner is fixed to the surface using heat and pressure. As a result, an image is formed on one side of the recording medium P. For double-sided image forming, the recording medium P is inverted after the toner image fixing process has been completed, and is conveyed along a sheet re-supply path and is again fed toward the secondary transfer roller 5*g*.

The image forming apparatus for this embodiment employs six toner colors, i.e., four toner colors of yellow (Y), magenta (M), cyan (C) and black (BK), which are used by a common, full color image forming apparatus, and an additional two colors of light (thin) magenta (LM) and light (thin) cyan (LC). Thus, six developing devices and six toner cartridges are provided. The purposes for which the light magenta toner and the light cyan toner are used is the downsizing of the printing dots for a halftone of an image and the formation of a stable halftone portion.

The developing apparatus 4 will now be described while referring to FIG. 2.

Figure 2:
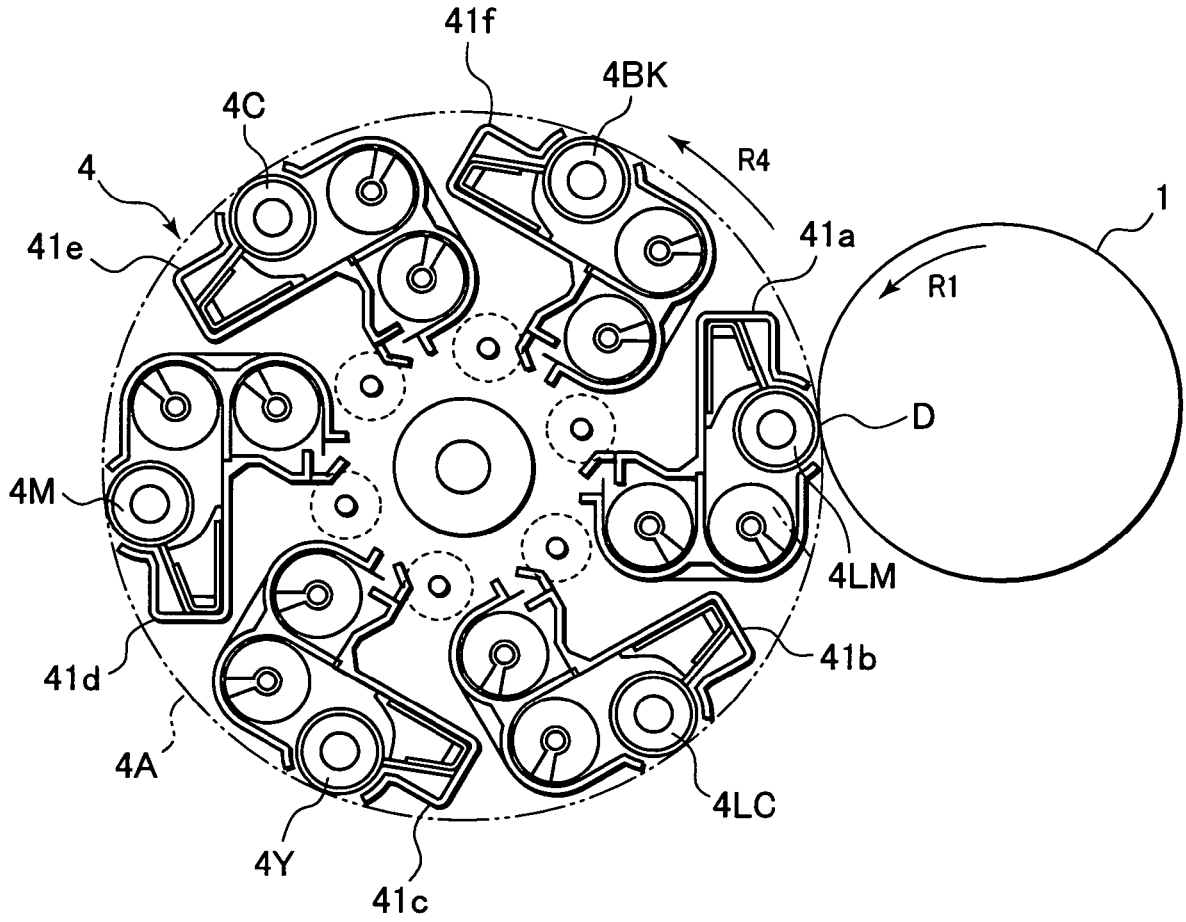
FIG. 2 is a vertical cross-sectional view (first attachment state) taken in a direction perpendicular to the rotary shaft of a developing apparatus according to a first embodiment of the invention.

FIG. 2 is a vertical cross-sectional view, taken in a direction perpendicular to a rotary shaft 40*c* (see FIG. 4) of the developing rotary 4A, of a state wherein the developing devices have been mounted at all of the mounting positions (attachment positions) for the developing rotary 4A of this embodiment. As is shown in FIG. 2, the developing apparatus 4 of this embodiment can hold the maximum six developing devices, and hereinafter, the state wherein all six developing devices are mounted is called a first attachment state.

As is described above, developers for six colors, i.e., the four common colors, yellow (Y), magenta (M), cyan (C) and black (BK), and additional two colors, light magenta (LM) and light cyan (LC), are loaded in the six developing devices 4Y, 4M, 4C, 4BK, 4LM and 4LC. That is, the six color developing devices are mounted on the developing rotary 4A of the developing apparatus 4.

The developing rotary 4A of this embodiment is rotated in the direction indicated by an arrow R4 (counterclockwise) in FIG. 2, and during the image forming (developing) process, the six colors are used in the order LM, LC, Y, M, C to BK. That is, as the developing rotary 4A is rotated, the developing devices are moved to the developing position D, opposite the photosensitive drum 1, in the order of 4LM, 4LC, 4Y, 4M, 4C and 4BK, and are used to develop electrostatic latent images and form toner images for the individual colors.

Figure 3A:
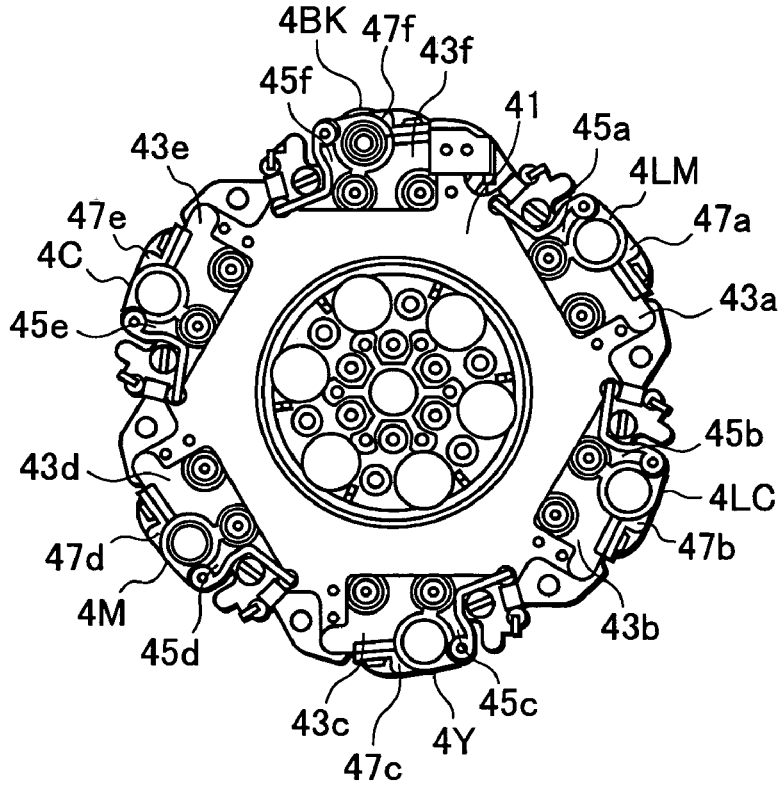
FIGS. 3A and 3B, respectively, are a front view and a rear view of the developing apparatus according to the first embodiment.
Figure 3B:
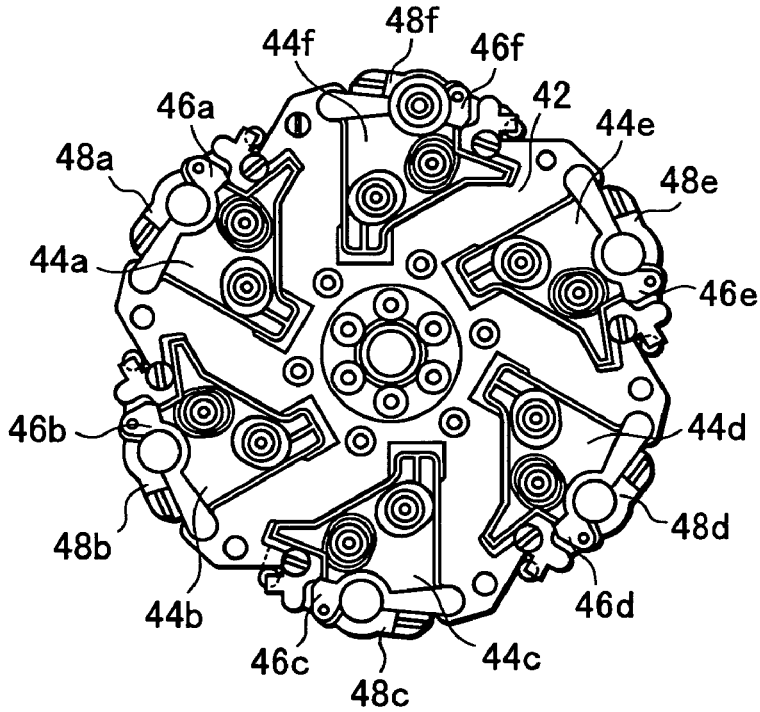
Figure 4:
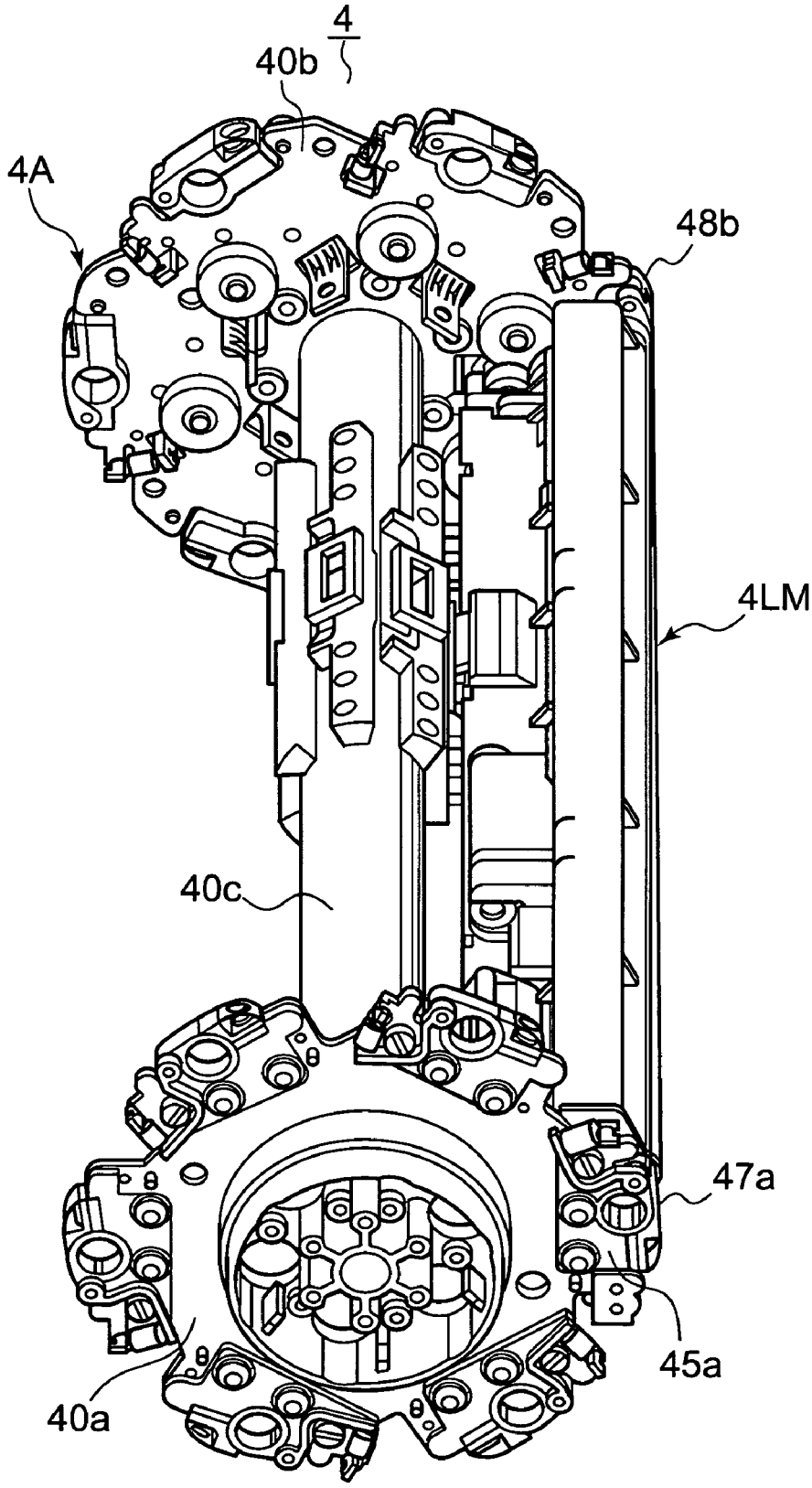
FIG. 4 is an obliquely downward perspective view of a developing rotary according to the first embodiment.

FIGS. 3A and 3B are views of the developing apparatus 4 taken respectively from the front and the rear of the main body M, and FIG. 4 is an obliquely downward perspective view of the developing rotary 4A. In the state shown in FIG. 4, all developing devices other than the light magenta developing device 4LM have been removed.

As shown in FIGS. 3A, 3B and 4, the developing rotary 4A includes a front side plate 40*a* and a rear side plate 40*b*, connected at their centers by the rotary shaft 40*c*.

Developing device attachment portions 43*a* to 43*f* are provided for the front side plate 40*a* of the developing rotary 4A, while developing device attachment portions 44*a* to 44*f* are provided for the rear side plate 40*b*. Further, sleeve holders 45*a* to 45*f* and sleeve supports 47*a* to 47*f*, for holding the longitudinal front ends of developing sleeves 40, are provided for the developing device attachment portions 43*a* to 43*f* of the front side plate 40*a*, and sleeve holders 46*a* to 46*f* and sleeve supports 48*a* to 48*f*, for holding the longitudinal rear ends of the developing sleeves 40, are provided for the developing device attachment portions 44*a* to 44*f* of the rear side plate 40*b*. As is shown in FIG. 4, the bearings on the front and rear ends of the developing sleeves 40 of the developing devices are fitted onto the sleeve holders 45*a* to 45*f* and 46*a* to 46*f*, and are accepted and secured by the sleeve supports 47*a* to 47*f* and 48*a* to 48*f*, which are fitted over the shafts of the individual sleeve holders 45*a* to 45*f* and 46*a* to 46*f*.

With the above-described identical structure, the individual developing devices are arranged at pitches of exactly 60.degree. in the developing rotary 4A.

Figure 5:
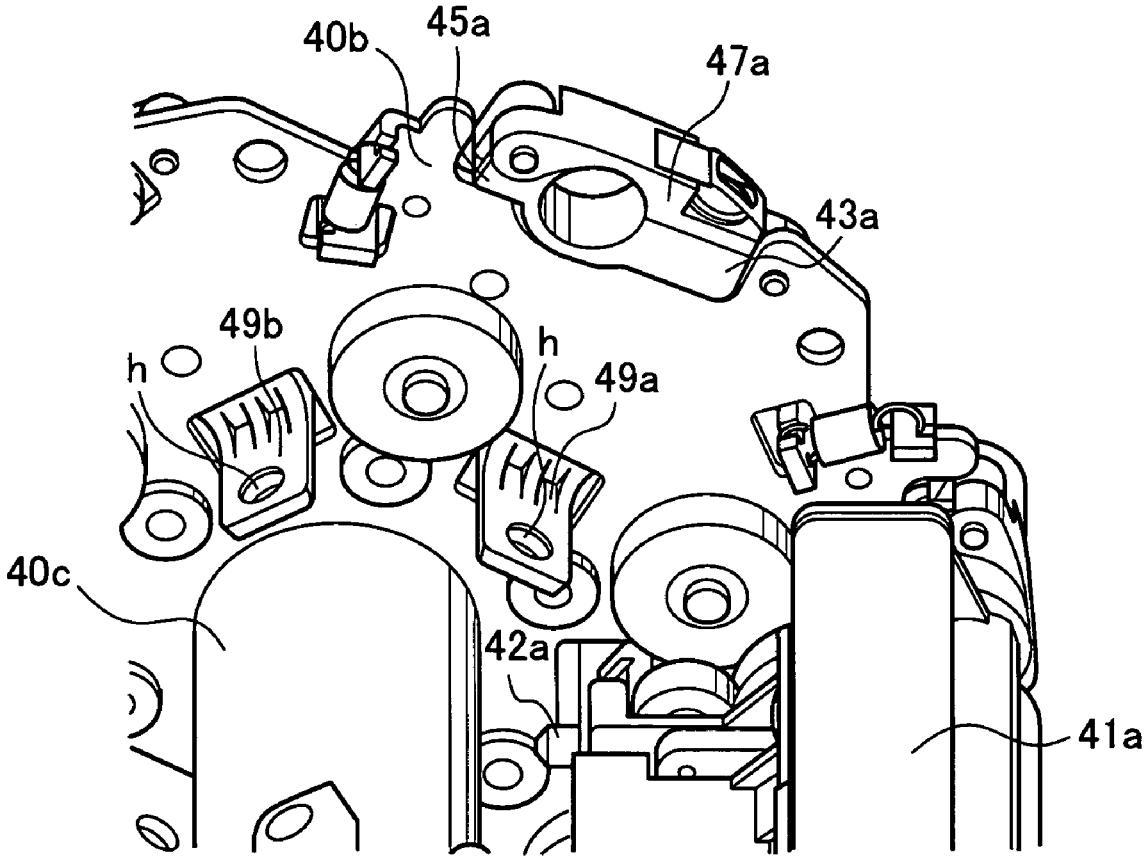
FIG. 5 is a perspective view of a portion of a developing rotary for the first embodiment whereto a developing device is attached.

Further, as shown in FIG. 5, on the front face of the rear side plate 40*b*, mounting portions 49*a* to 49*f* (49*c* to 49*f* not shown) are fixed at positions whereat the rear side plate 40*b* is divided equally in the circumferential direction (into six fragments in this embodiment). The mounting portions 49*a* to 49*f* are used to mount developer containers 41*a* to 41*f* (41*b* to 41*f* not shown) for the developing devices, and serve as stoppers for the respective developing devices. Engagement holes h are formed in the mounting portions 49*a* to 49*f*, and engagement pins 42*a* to 42*f* (42*b* to 42*f* not shown), which project outward from the developer containers 41*a* to 41*f*, are inserted into the engagement holes h. In this manner, the postures of the developing devices attached to the developing rotary 4A can be maintained.

After the developing devices wherein the respective color developers have been filled are fixed to the developing rotary 4A, the sleeve holders 45*a* to 45*f* and 47*a* to 47*f* are secured to the front and rear side plates 40*a* and 40*b* of the developing rotary 4A, so that the distance between the developing sleeves 40 and the photosensitive drum 1 is a desired value.

As a result, the developing process can be performed while the gap between the developing sleeve 40 of each developing device and the photosensitive drum 1 is maintained. With this configuration, the image forming processing is performed in the above described manner. That is, the process whereby the developing devices are switched, as the developing rotary 4A is rotated, is repeated a number of times, the equivalent of the number of colors required. Each time a toner image for one color is formed, the toner image is transferred to the intermediate transfer belt 5*a*. Thus, the number of times the intermediate transfer belt 5*a* is rotated is equivalent to the number of colors required, so that the toner images can be superimposed on the intermediate transfer belt 5*a*.

The second attachment state of the developing apparatus 4 will now be described in detail while referring to FIG. 6.

The same developing rotary 4A as that used for the first attachment state is employed. That is, between the first and the second attachment states, only the number of developing devices to be attached to the developing rotary 4A differs.

Figure 6:
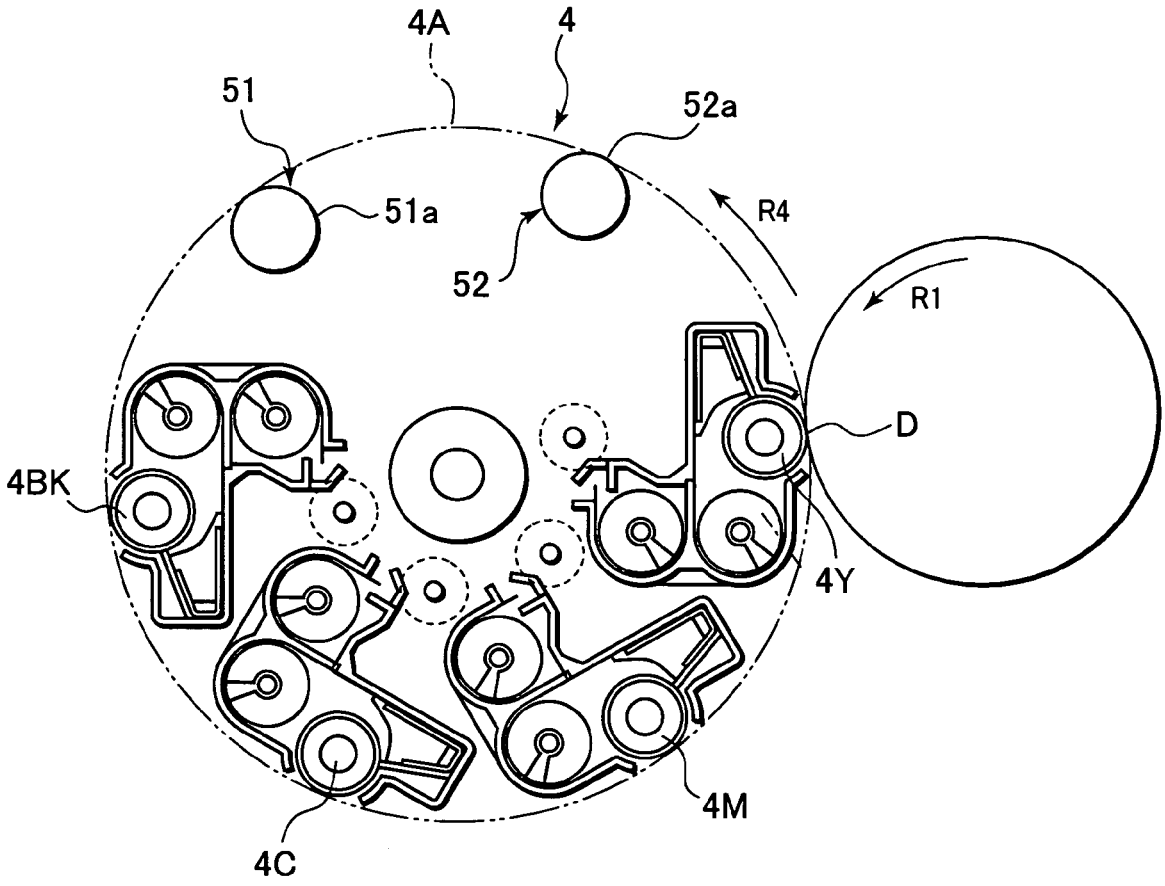
FIG. 6 is a vertical cross-sectional view for explaining a second attachment state according to the first embodiment.

As shown in FIG. 6, four developing devices 4Y, 4M, 4C and 4BK are attached, and developers for four colors, yellow (Y), magenta (M), cyan (C) and black (BK), are respectively retained.

Further, in order to maintain the rotation balance of the developing rotary 4A, balance weights 51 and 52 are attached at the mounting position for the developing device 4LM, which holds a light magenta developer, and at the mounting position for the developing device 4LC, which holds a light cyan developer.

The balance weights 51 and 52 are attached to the developing rotary 4A using the same method as that used to attach the developing devices. This is done because the single developing rotary 4A is employed to provide both the first attachment state and the second attachment state, without any special mounting portions being required.

Figure 7:
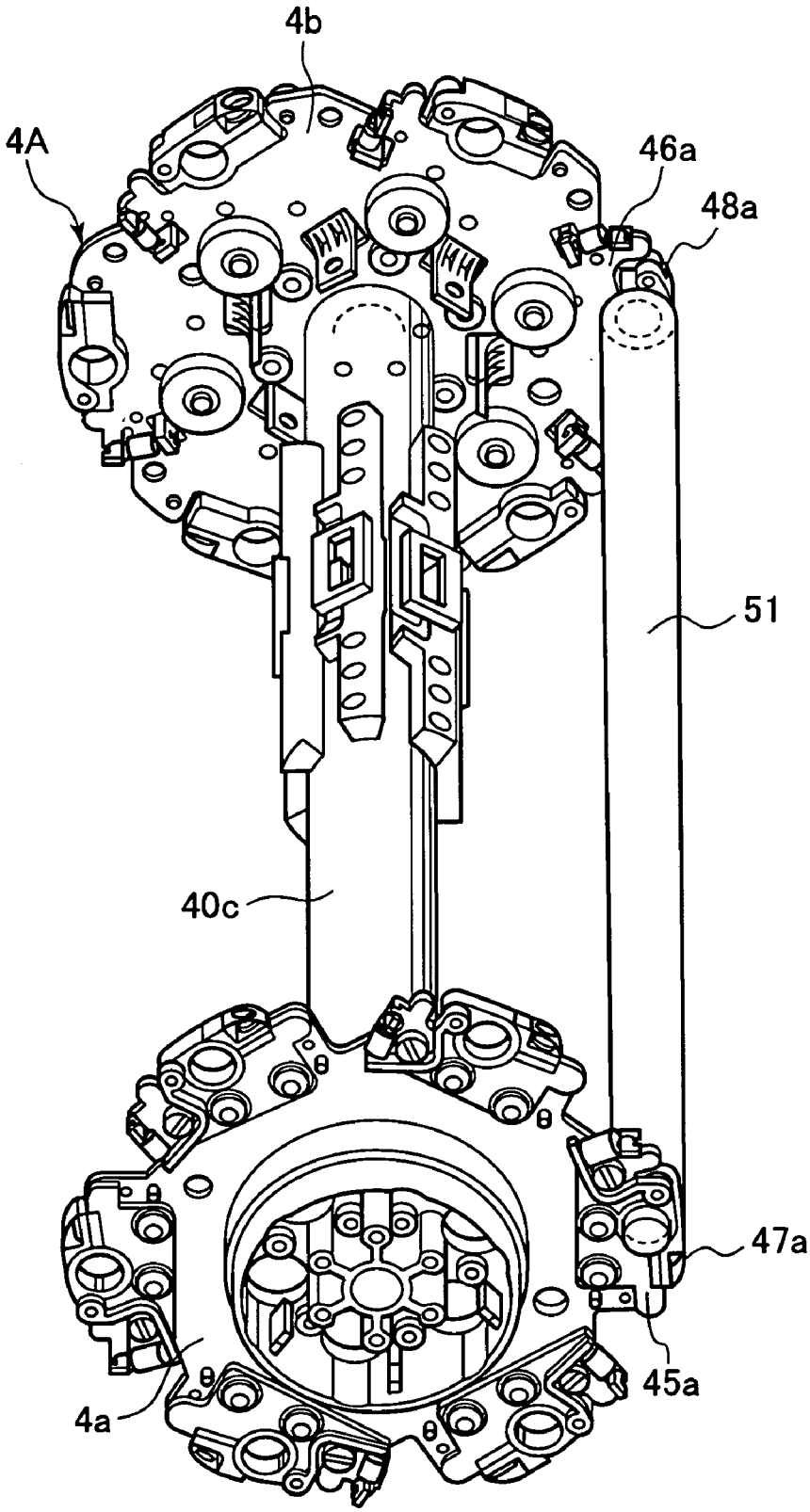
FIG. 7 is a perspective view for explaining the attachment of balance weights in the second attachment state according to the first embodiment.

In this embodiment, since the balance weights 51 and 52 are cylindrical, stoppers are not required, and as is shown in FIG. 7, for example, the longitudinal ends of these weights 51 and 52 are sandwiched and secured by the sleeve holders 45*a* and 46*a* and the sleeve supports 47*a* and 48*a*. This securing method is the same as that used for the developing sleeves 40.

Furthermore, as a reference, the rotational inertia for the balance weights 51 and 52 at the center of the rotational shaft 40*c* of the developing rotary 4A is set substantially equal to the rotational inertia of the developing device whereat the developer is loaded. This is done in order to obtain a uniform rotation balance.

In addition, the center (of gravity) positions of the balance weights 51 and 52 are located nearer the outer edge of the developing rotary A than are the gravity positions of the developing devices, so that a rotational inertia equal to that of the developing device can be obtained by employing only the small diameter balance weights 51 and 52. Employment of this structure depends on the fact that the rotational inertia around the rotational shaft 40*c* increases as the weight approaches the outer edge of the developing rotary 4A. As a result, the size of the balance weights 51 and 52 and the costs therefor can be reduced.

In the image forming apparatus of this embodiment, as is shown in FIG. 1, toner supply units (developer feed units) for six individual colors are arranged in the upper portion of the reader B. Since the toner supply units 25 feed to the developing devices of the developing rotary 4A an amount of toner equivalent to the toner consumed, an almost constant amount of toner can be supplied to the developing rotary 4A. While also taking this into account, the developing rotary 4A is designed so that the rotational balance can be accurately maintained.

Since the balance weights 51 and 52 are arranged near the outer edges of the front and rear side plates of the developing rotary 4A, and since the balance weights 51 and 52 are located inside the developing rotary 4A, i.e., near the photosensitive drum 1 so that a high voltage contact is maintained, and since toner is present around the balance weights 51 and 52, non-magnetic SUS (stainless steel) is employed for the balance weights 51 and 52. Further, sheets of insulating material (insulating members) 51*a* and 52*a* of about 100 μm are adhered, at the least, to the portions, on the surfaces (outer surfaces) of the balance weights 51 and 52, that are opposite the photosensitive drum 1.

When the non-magnetic material is employed for the balance weights 51 and 52, the following advantages are obtained: there is no magnetic affect on the circulation of the developer in an adjacent developing device; peripherally dispersed toner is not attracted and smudging of the balance weights 51 and 52 is prevented; and an adverse affect on the balance weights 51 and 52, which are covered with toner, does not affect the photosensitive drum 1 and other components. Further, since the insulating sheets 51 and 52 are applied, the perceived advantages are that the potential of the photosensitive drum 1 is not changed when the balance weights 51 and 52 pass the surface of the photosensitive drum 1, and that the current, at a high voltage, is prevented from leaking from the balance weights to the photosensitive drum 1 or vice versa.

As is described above, while the balance weights 51 and 52 are attached to the developing rotary 4A, no adverse affect, such as smudging, a potential change, a high voltage abnormality or an erroneous operation, impacts on the performance of the photosensitive drum 1 and the other image forming components, and the image forming operation. Further, the appropriate image forming processing can be performed while the correct rotational balance of the developing rotary 4A is guaranteed, and uneven rotation does not occur when the developing rotary 4A is driven.

<Second Embodiment>

Figure 8:
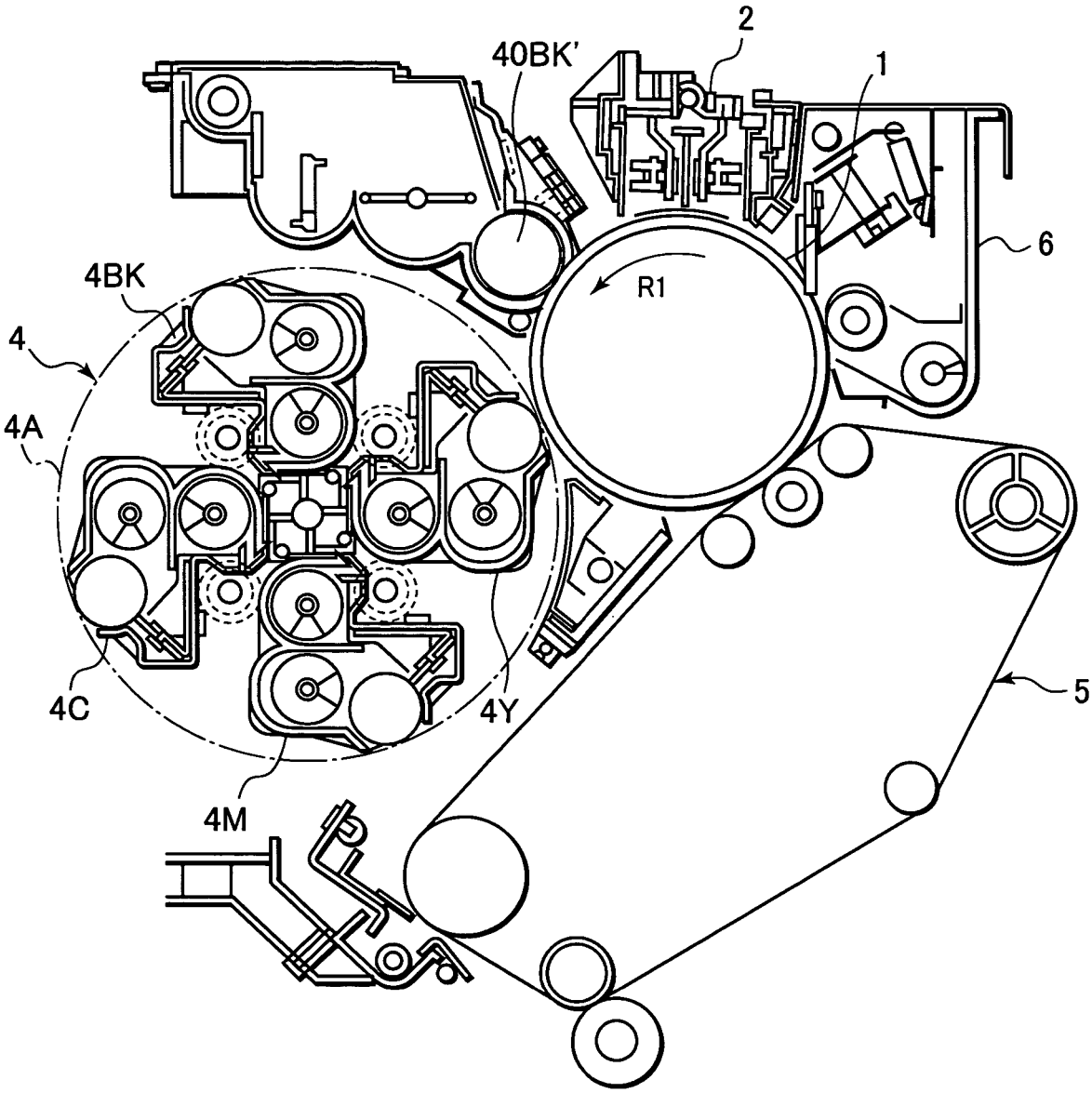
FIG. 8 is a vertical cross-sectional view of the configuration of a developing apparatus according to a second embodiment of the invention.
Figure 9:
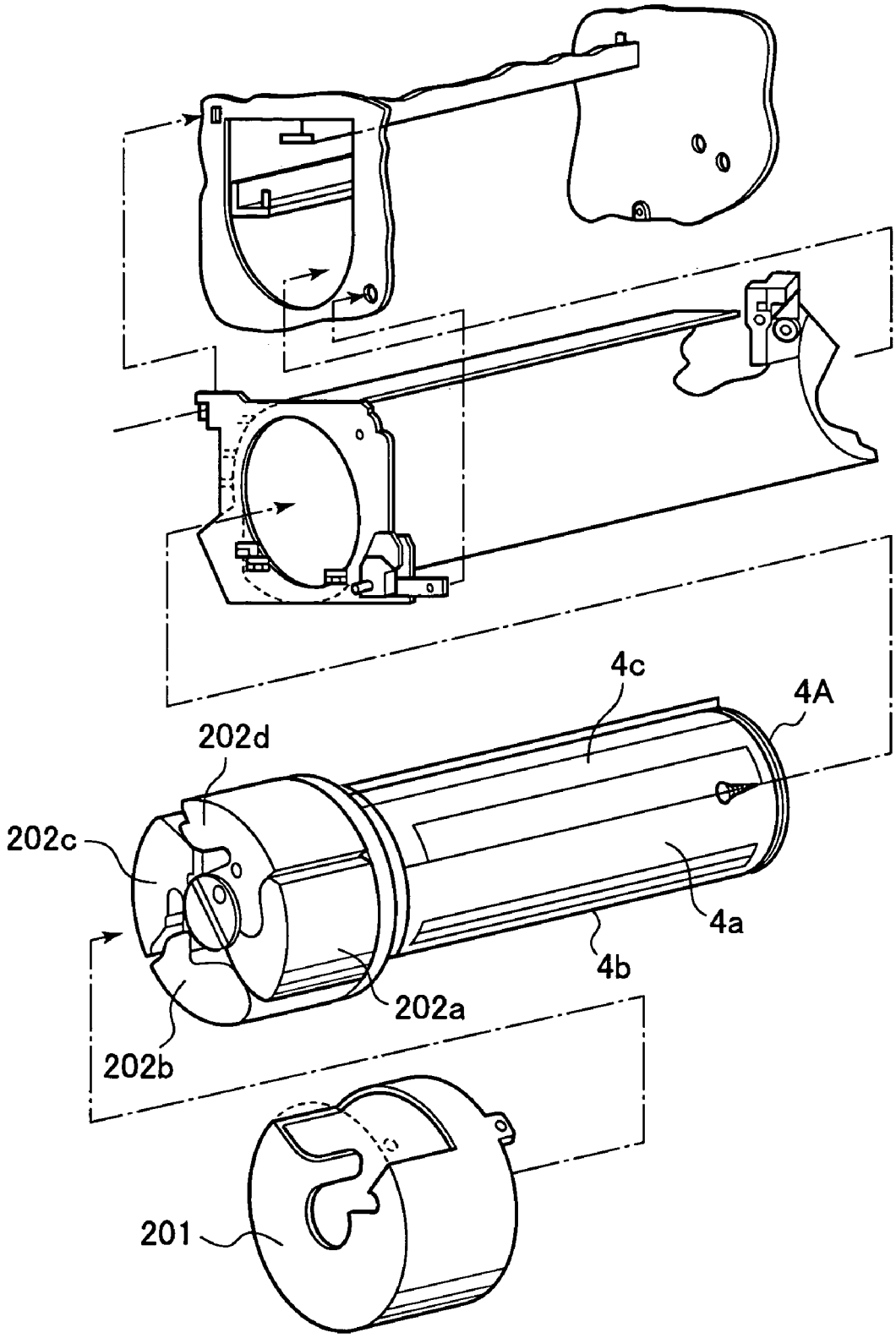
FIG.9 PRIOR ART
FIG. 9 is a diagram for explaining a developing apparatus disclosed in JP-A-Hei 09-288419.
Figure 10:
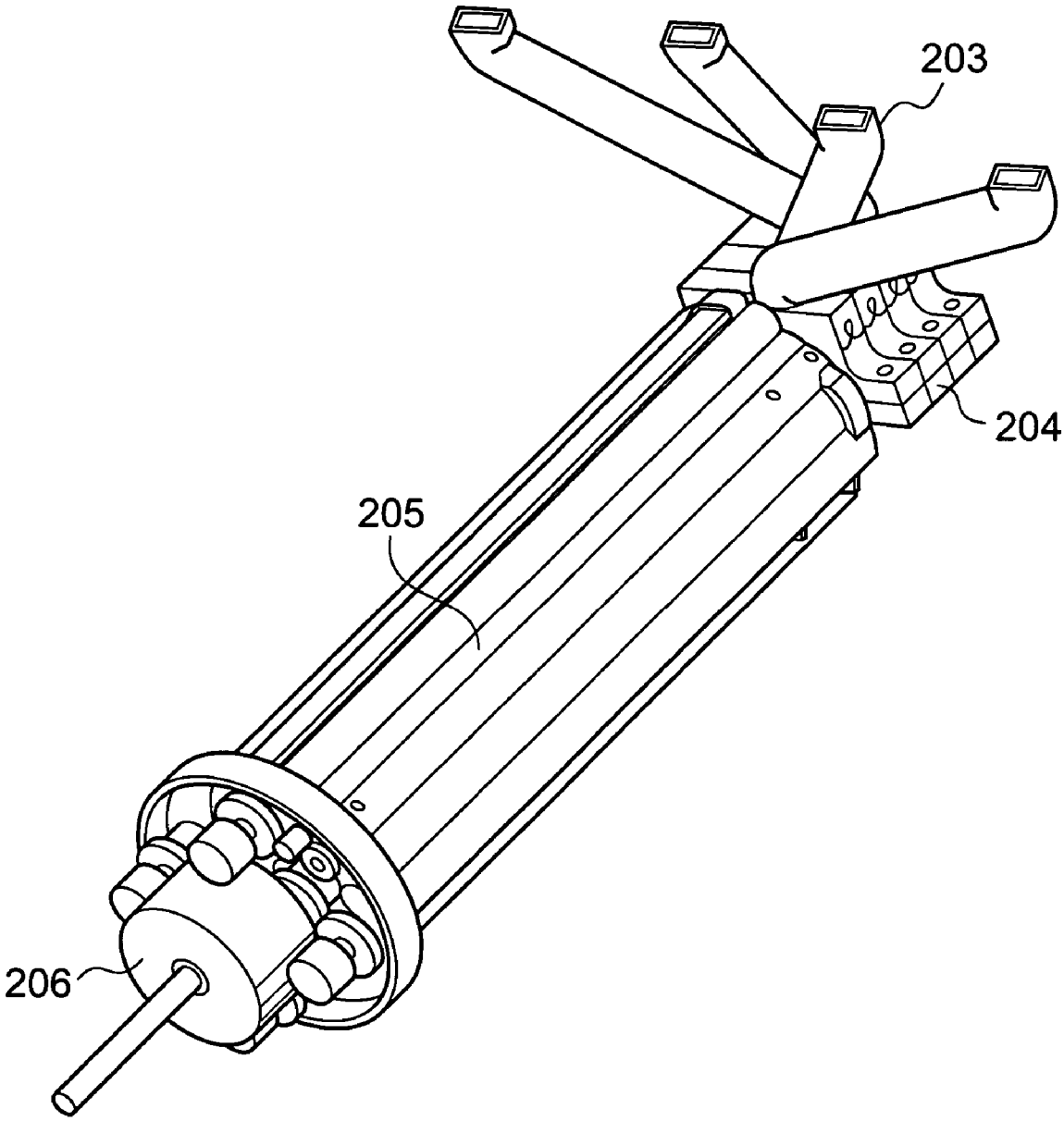
FIG.10 PRIOR ART
FIG. 10 is a diagram for explaining a developing apparatus disclosed in JP-A-2001-1134045.
Figure 11A:
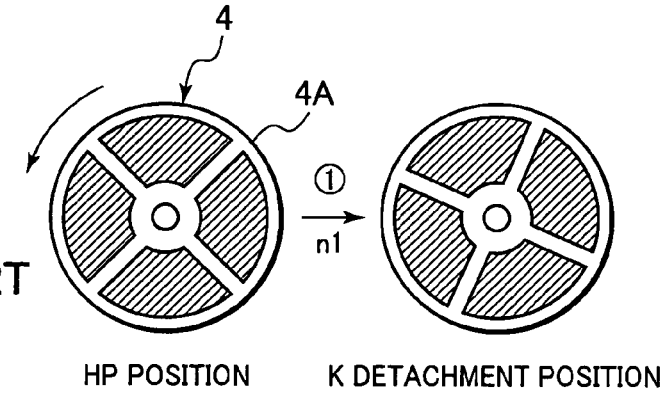
FIG.11A PRIOR ART
FIGS. 11A to 11C are diagrams for explaining a developing apparatus disclosed in JP-A-2003-050494.
Figure 11B:
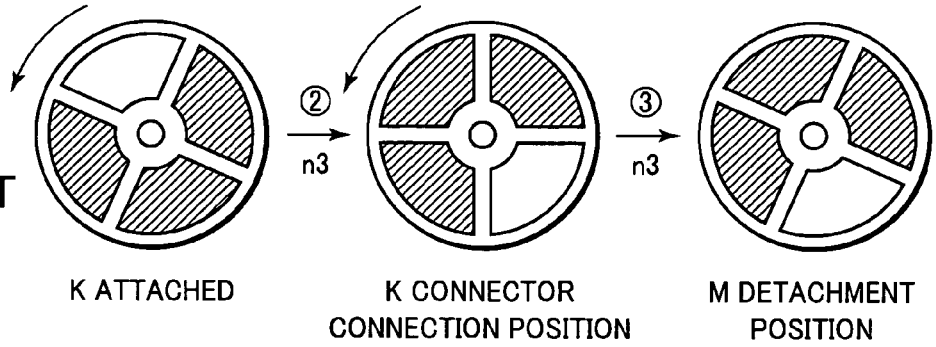
FIG.11B PRIOR ART
Figure 11C:
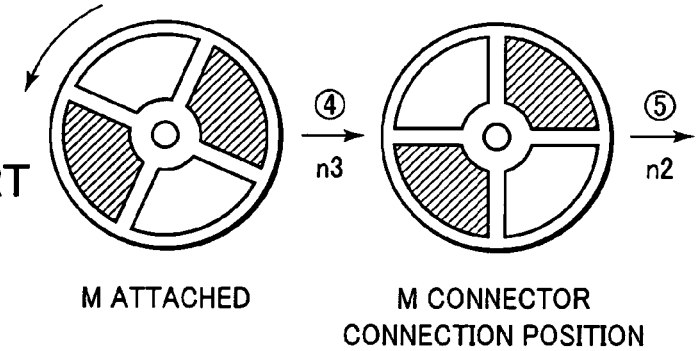
FIG.11C PRIOR ART
Figure 12:
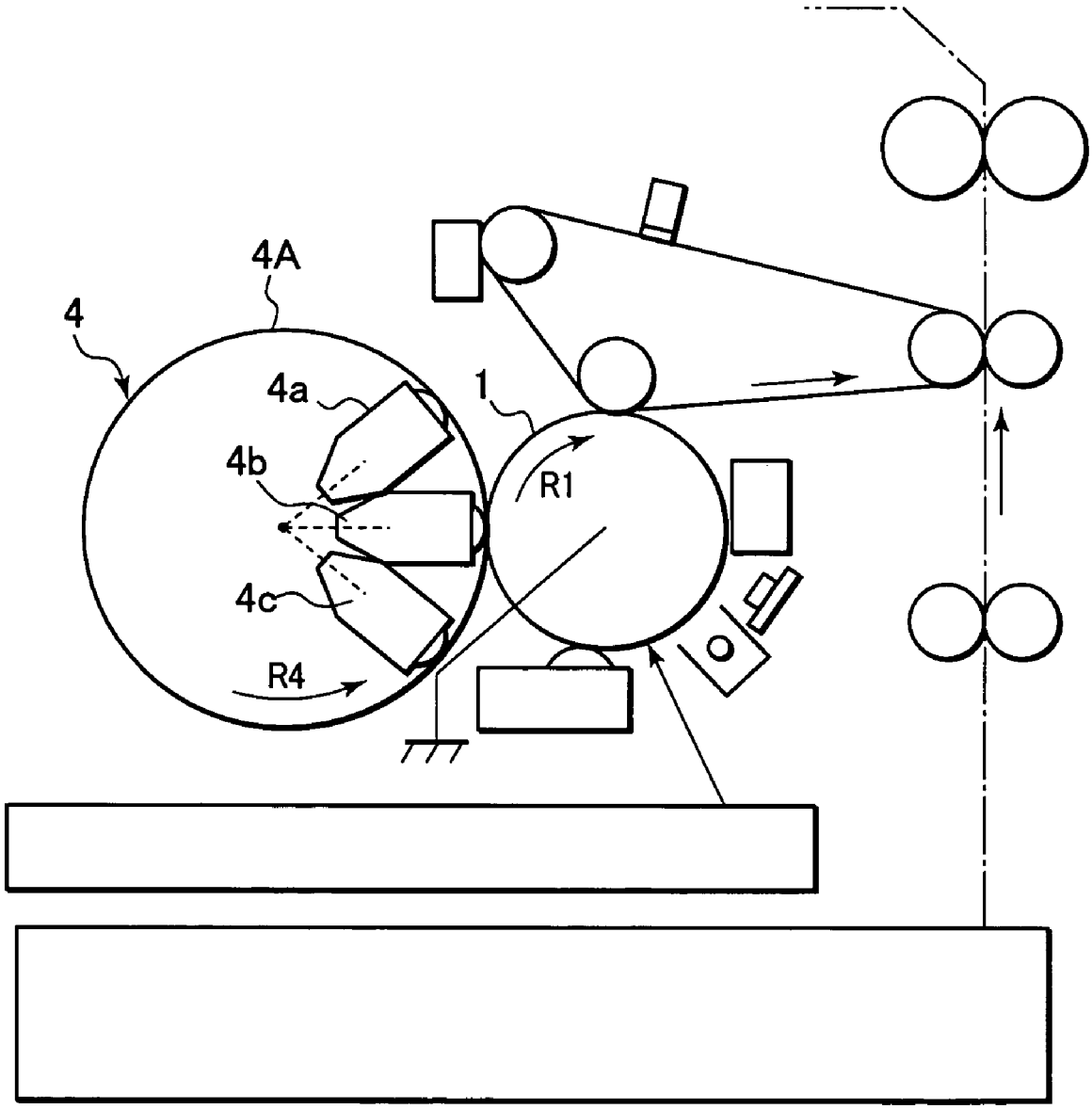
FIG.12 PRIOR ART
FIG. 12 is a diagram for explaining a developing apparatus disclosed in JP-A-2003-233239.

In the first embodiment, the state wherein developing devices for six different colors are mounted in the developing rotary 4A is defined as the first attachment state, and the state wherein developing devices for four colors are mounted is defined as the second attachment state. However, the present invention can also be applied for an image forming apparatus such as is shown in FIG. 8, wherein four developing devices 4Y, 4M, 4C and 4BK, filled with two-component developers that contain yellow, magenta, cyan and black toners and a carrier as the main elements, are mounted in a developing rotary 4A, and wherein a black developing device 4BK', filled with a one-component developer, is mounted upstream of a developing apparatus 4 in the rotational direction (indicated by an arrow R1) of a photosensitive drum 1.

While taking into account the technical background information that, at the least, one black developing device must be mounted to obtain a full color image, that the running cost is lower when a one-component developing device is used, that the developing rotary 4A need not be rotated in a single black mode, and that a two-component developing device is preferable to obtain a satisfactory high resolution image, the following first and second attachment states are available. As the first attachment state, the two-component developing devices 4Y, 4M, 4C and 4BK, for four colors, are mounted on the developing rotary 4A, and in addition to these devices on the developing rotary 4A, the black, one-component developing device 4BK' is mounted near the outer edge of the photosensitive drum 1. As the second attachment state, the yellow and magenta two-component developing devices are mounted on the developing rotary 4A, and the black, one-component developing device 4BK' is mounted near the outer edge of the photosensitive drum 1.

Thus, a feature of the image forming apparatus in the first attachment state is that for four-color image forming, a high resolution image forming mode can be performed by using the four two-component developing devices 4Y, 4M, 4C and 4BK mounted on the developing rotary 4A, and that, for black image forming, a low-cost mode can be performed by using the one-component developing device 4BK'.

A feature of the image forming apparatus in the second attachment state is that image forming is performed by using the black, one-component developing device 4BK' instead of the black, two-component developing device 4BK, and that the cost of the main body can be reduced because a smaller number of developing devices is required.

For this image forming apparatus having the two different attachment states, when the black developing device 4BK in the developing rotary 4A is replaced by a balance weight in the second attachment state, the two attachment states can be provided using the same image forming configuration and the same developing rotary structure. Furthermore, uneven rotation of the developing rotary 4A, when driven in the second attachment state, is removed, and image deterioration caused by driving the developing rotary 4A is prevented, so that a satisfactory image can be obtained.

While the present invention has been described with reference to exemplary embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

This application claims priority from Japanese Patent Application No. 2004-134763 filed Apr. 28, 2004, which is hereby incorporated by reference herein.

What is claimed is:

1. A developing apparatus for developing an electrostatic image on an image bearing member comprising:

a rotary member including a plurality of mounting portions, to which a plurality of developing devices and a plurality of balance weights are detachably mountable, wherein the rotary member selectively shifts a mounted developing device to a developing position opposite to the image bearing member, and wherein a developing process is performed in a first mode in which developing devices are attached to all the mounting portions, and in a second mode in which a developing device is mounted to at least one of the mounting portions, and no developing devices are mounted to the remaining mounting portions, and wherein, in the second mode, balance weights are mounted to the remaining mounting portions.

2. A developing apparatus according to claim 1, wherein a rotational inertia, when the rotary member is rotated with balance weights mounted thereto, substantially equals a rotational inertia when the rotary member is rotated with developing devices mounted thereto.

3. A developing apparatus according to claim 1, wherein a center of gravity of the weight mounted to the rotary member is farther from the rotation center of the rotary member than a center of gravity of the developing device attached to the rotary member.

4. A developing apparatus according to claim 1, wherein the plurality of mounting portions respectively include attachment portions for interchangeably mounting developing devices and balance weights thereon.

5. A developing apparatus according to claim 1, wherein the balance weights are made of a non-magnetic material.

6. A developing apparatus according to claim 1, wherein an insulating member is at least provided on a surface portion of the balance weight opposite to the image bearing member.

7. A developing apparatus according to one of claims 1 to 6, wherein the developing devices mounted to the rotary member in the second mode respectively contain yellow, magenta and cyan toners.

8. A developing apparatus according to one of claims 1 to 6, wherein the developing devices mounted to the rotary member in the second mode respectively contain yellow, magenta, cyan and black color toners.

9. A developing apparatus for developing an electrostatic image on an image bearing member comprising:

a developing rotary including a first side plate and a second side plate, each side plate including a plurality of mounting portions, each mounting portion being adapted to interchangeably, detachably mount a developing device and a balance weight;

the first side plate including a number of sleeve holders and sleeve supports provided in pairs and disposed about the first side plate at mounting portions, which are spread equidistantly in a circumferential direction of the developing rotary; and the second side plate including a like number of sleeve holders and sleeve supports provided in pairs and disposed about the second slide plate at mounting portions, which are spaced equidistantly in the circumferential direction of the developing rotary, wherein the developing rotary selectively shifts a mounted developing device to a developing position opposite to the image bearing member, and wherein a developing process is performed in a first mode in which developing devices are attached to all the mounting portions, and in a second mode in which a developing device is mounted to at least one of the mounting portions, and no developing devices are mounted to the remaining mounting portions, and wherein, in the second mode, balance weights are mounted to the remaining mounting portions.

10. A developing apparatus according to claim 9, wherein a center of gravity of the balance weight mounted to the developing rotary is farther from the rotation center of the developing rotary than a center of gravity of the developing device attached to the developing rotary.

11. A developing apparatus according to claim 9, wherein the balance weights are made of a non-magnetic material.

12. A developing apparatus according to claim 9, wherein an insulating member is provided on a surface portion of a balance weight opposite to the image bearing member.

13. A developing apparatus according to claim 12, wherein the insulating member is a sheet of insulating material adhered to the surface portion.

* * * * *

UNITED STATES PATENT AND TRADEMARK OFFICE

CERTIFICATE OF CORRECTION

PATENT NO. : 7,187,891 B2
APPLICATION NO. : 11/113246
DATED : March 6, 2007
INVENTOR(S) : Akinori Tanaka It is certified that error appears in the above-identified patent and that said Letters Patent is hereby corrected as shown below:

ON THE TITLE PAGE:
At Item (56), References Cited, Foreign Patent Documents, "57070547 A" should read --57-070547 A--, and "2003173080 A" should read --2003-173080 A--.

COLUMN 3:
Line 51, "parts," should read --portions,--.
Line 54, "parts," should read --portions,--.
Line 56, "parts." should read --portions,--.

COLUMN 7:
Line 25, "60. degree. in" should read --60° in--.
Line 51, "above described" should read --above-described--.

COLUMN 8:
Line 65, "affect" should read --effect--.

COLUMN 9:
Line 1, "affect" should read --effect--.

Signed and Sealed this

Twentieth Day of November, 2007

JON W. DUDAS
*Director of the United States Patent and Trademark Office*